US005823847A

United States Patent [19]

Gellman

[11] Patent Number: 5,823,847

[45] Date of Patent: Oct. 20, 1998

[54] MOVING MOUTH MECHANISM FOR ANIMATED CHARACTERS

[75] Inventor: Jonathan Gellman, New York, N.Y.

[73] Assignee: Pragmatic Designs, Inc., City Island, N.Y.

[21] Appl. No.: 801,197

[22] Filed: Feb. 18, 1997

[51] Int. Cl.[6] ..... A63H 03/28

[52] U.S. Cl. ..... 446/301; 446/337

[58] Field of Search ..... 446/301, 337, 446/395

[56] References Cited

U.S. PATENT DOCUMENTS

| | | | |
|---|---|---|---|
| 1,920,027 | 7/1933 | Wilhelm | 446/301 |
| 2,250,916 | 7/1941 | Magruder . | |
| 3,230,664 | 1/1966 | Bornn . | |
| 3,230,665 | 1/1966 | Ryan . | |
| 3,364,618 | 1/1968 | Ryan . | |
| 3,421,254 | 1/1969 | Ryan . | |
| 4,244,138 | 1/1981 | Holahan et al. | 446/301 |
| 4,665,640 | 5/1987 | Forsee . | |
| 4,775,352 | 10/1988 | Curran . | |
| 4,805,328 | 2/1989 | Mirahem . | |
| 4,808,142 | 2/1989 | Berliner | 446/353 |
| 4,864,607 | 9/1989 | Mitamura . | |
| 5,074,821 | 12/1991 | McKeefery et al. | 446/301 |
| 5,108,341 | 4/1992 | Desmet | 446/229 |
| 5,376,038 | 12/1994 | Arad | 446/297 |
| 5,413,516 | 5/1995 | Lam | 446/301 |

FOREIGN PATENT DOCUMENTS

| | | | |
|---|---|---|---|
| 770508 | 10/1980 | U.S.S.R. | 446/353 |
| 995974 | 6/1965 | United Kingdom | 446/301 |

*Primary Examiner*—Robert A. Hafer
*Assistant Examiner*—Jeffrey D. Carlson
*Attorney, Agent, or Firm*—Martin Smolowitz

[57] ABSTRACT

A moving mouth mechanism for an animated character, the mechanism being mounted within the head of the animated character, such as a doll. A head member of the character has an electrical motor mounted in the head upper portion, and has an elongated flexible element or string attached at one end to a rotatable shaft extension of the motor. The other end of the string is attached to a pivotable lever which is spring actuated. The lever outer end is attached to a pivotable lower lip of the mouth in the head, so that whenever the motor is activated with an electrical signal such as from an audio and control system for the activated character, the pivotable lower lip is movable upward and downward so as to simulate normal realistic speech for the animated character.

13 Claims, 1 Drawing Sheet

MOVING MOUTH MECHANISM FOR ANIMATED CHARACTERS

BACKGROUND OF INVENTION

This invention pertains to a moving mouth mechanism used in an animated character such as a doll or figurine. It pertains particularly to such a mechanism for providing simulated speech for the character and which is operated by combined audio and control signals.

In the field of animated characters such as dolls and figurines, it is usually desirable to make the figurine as lifelike as possible. To this end, sound or speech producing mechanisms are incorporated into such animated dolls and figurines, giving the illusion that the doll is actually speaking. To enhance realism, intermittent motion is usually imparted to the mouth of the doll. Prior implementations of moving mouth mechanisms for animated characters generally fall into two categories or types: (a) those that move relatively rapidly and can be easily synchronized to electronically-generated speech; and (b) those that because of gearing or other such mechanical force amplifiers are incapable of rapid motions such as naturally occur in human speech, and are difficult to synchronize to generated speech. Undesired gearbox noise is also a serious drawback for the latter type. Although the former type produce more lifelike motions, they are generally incapable of exerting much mechanical force and usually take the form of a lightweight "flapper" element actuated by a magnetic coil or solenoid. This "flapper" element is typically somewhat unnatural in appearance, because it must be separate and noncontiguous with the remaining facial structure of the doll. The latter geared category of devices can generate considerable force due to the mechanical advantage provided by the gearing, and can therefore be installed behind a contiguous plastic face covering typical of that used in dolls, and can have a more natural static appearance. However, the slower moving gearing precludes natural animation and synchronization of speech.

Some such animated characters or dolls are disclosed by various prior art patents. For example, U.S. Pat. No. 3,230,664 to Bornn et al discloses a doll having movable lips in which the mouth is controlled by a spring-biased pivoting jaw and gearing arrangement. U.S. Pat. Nos. 3,230,665 and 3,364,618 to Ryan disclose a doll having eye and lip movements provided by mechanically actuated fingers in response to a phonograph, which is actuated by a spring and drawstring. Also U.S. Pat. No. 4,775,352 to Curran et al discloses an animated audio doll having eyes and mouth actuated by a drive motor and a cam and spring arrangement. However, all these prior art talking doll mechanisms each have various undesired deficiencies.

The present invention overcomes the above disadvantages and limitations by providing a moving mouth mechanism for animated characters which offers rapid motion, ease of synchronization, quiet operation, and considerable mechanical force to the mouth mechanism. Furthermore, it accomplishes these objectives in a simple and cost-effective manner, without the use of undesired gearing in the animated character.

SUMMARY OF INVENTION

The present invention provides a moving mouth mechanism for animated characters such as for a doll or figurine, the character being comprised of a head member having a lower pivotable lip element and a lever element being attached to the lower lip element, and an electric motor having a rotatable shaft extension mounted in the head member. An elongated flexible element such as a string having minimal elasticity, has one end attached around the motor rotatable shaft extension, and has the string other or lower end attached to the lever element inner end. The lever element is attached at its outer end to the head member pivotable lower lip or lower jaw element. A resilient element such as a tension or compression-type spring is attached to the lever at an intermediate point and acts to return the mouth pivotable lip element to a closed position. When the electric motor is actuated by a power source, the elongated flexible element is wound onto the rotatable shaft extension, thereby pulling the lever and lower lip elements into an "open mouth" position. When the power source is disconnected from the motor, the spring forces the lever element into a "closed mouth" position, thereby reversing the motor shaft rotation and unwinding the elongated flexible element from the rotatable motor shaft extension. If power is applied to and removed from the motor in synchrony with speech sounds generated by an audio and control system, a realistic animated character figure having mouth openings simulating normal speech is achieved.

This invention advantageously provides a moving mouth mechanism for animated characters such as dolls and figurines which is simple in its construction and quiet in its operation, and which produces rapid movements for the mouth of the character so as to simulate smooth, realistic speaking actions and sounds.

BRIEF DESCRIPTION OF DRAWINGS

This invention will be described further with reference to the following drawings, in which.

DETAILED DESCRIPTION OF INVENTION

Figure 1:
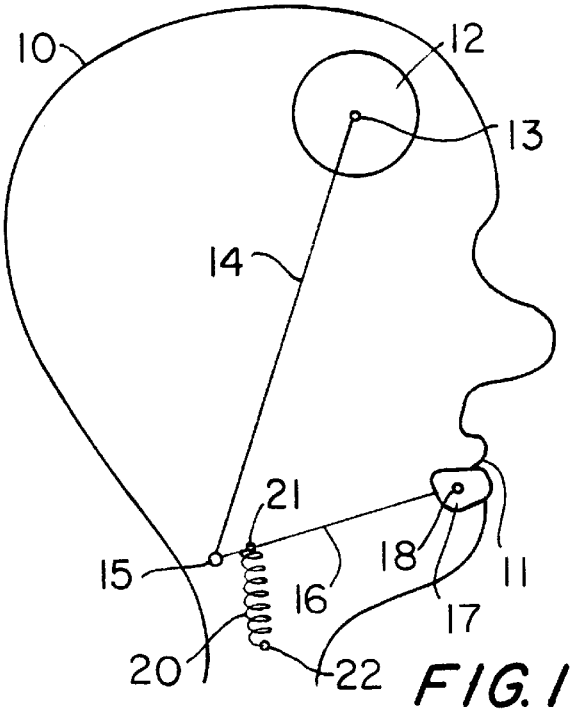
FIG. 1 is a schematic side view drawing showing a doll head for an animated character containing a moving mouth mechanism attached to the doll lower lip, which is in a closed mouth position.
Figure 3:
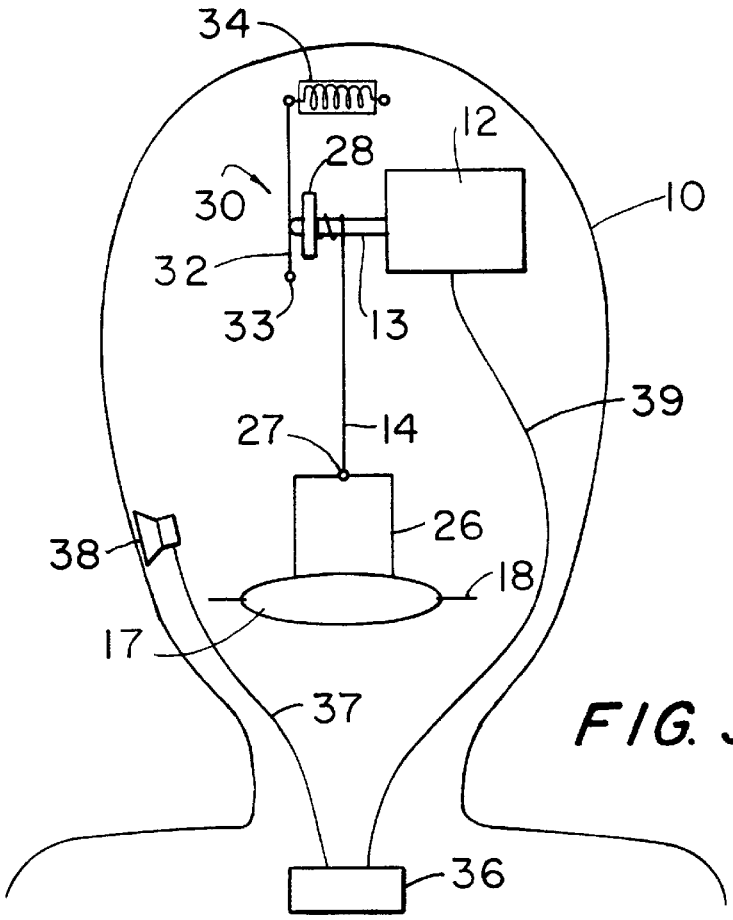
FIG. 3 is a schematic front view of an animated character including a doll head containing the moving mouth mechanism and an audio and control system according to the invention.

Referring to FIG. 1, a doll or figurine head 10 contains the moving mouth mechanism and shows the mouth 11 in its closed positions. An electric motor 12 is mounted in the upper portion of the head 10. The upper end of a flexible string 14 is attached to an integral rotatable shaft 13 of the motor 12, which shaft has a spool end 28 as seen in FIG. 3 but omitted in FIG. 1 for clarity. The string 14 other or lower end is connected to attachment point 15 on the inner end of a pivotable lever arm 16. The outer end of lever arm 16 is rigidly attached to lower lip 17 of the mouth 11, and together they pivot on axis 18. An alternative embodiment could have lower lip 17 of the head 10 molded of an elastic material and mounted integral to head 10, thereby providing greater realism in characters for which facial hair does not help obscure the separate lower lip.

A tension spring 20 is attached to and applies downward force to the inner end of pivotable lever arm 16, thereby causing the lower lip 17 of mouth 11 to remain in the closed mouth position when the electric motor 12 is not activated. The tension spring 20 is attached at its upper end to lever arm 16 at an intermediate attachment point 21, which is preferably near the string attachment point 15, and is attached at its lower end 22 within the head 10 in such a manner that allows the lever arm 16 to pivot about the axis 18 as the lower lip 17 of the mouth 11 is opened and closed. If desired, other elastic or resilient devices could be used to return the pivoted lever arm 16 of the moving mouth mechanism to the closed mouth position, such as different types of springs, rubber bands, etc.

Figure 2:
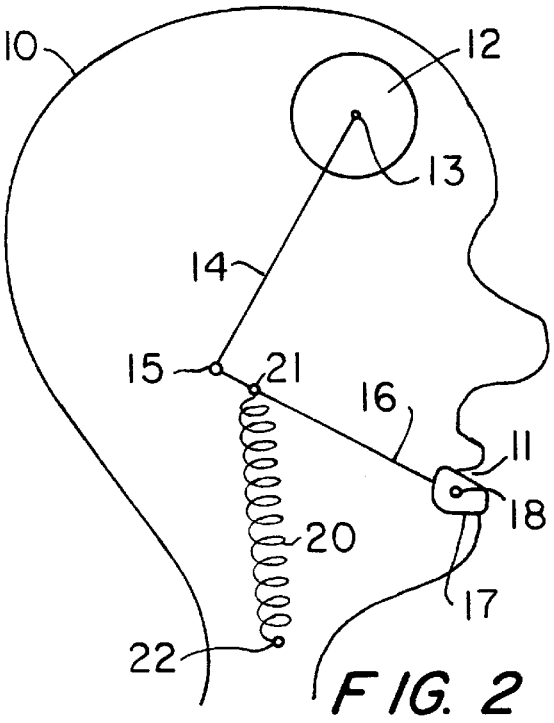
FIG. 2 shows a doll head similar to FIG. 1 but with the moving mouth mechanism attached to the doll lower lip shown in an open mouth position.

Referring now to FIG. 2 which shows the doll head 10 with the mouth 11 in its open position, the electric motor 12 has been energized (in either direction of rotation), thereby causing the string 14 to be wound onto motor shaft 13 and thereby rotating lever arm 16 upwardly and lower lip 17 downwardly about its axis 18, and opening the mouth 11. The upper surface of lower lip 17 may be decorated to simulate interior mouth parts so as to enhance realism for the animated character. The lower lip 17 of mouth 11 continues to open while electric power is connected to the motor 12, and the tension spring 20 becomes fully extended as shown. Then when electric power is disconnected from motor 12 by a control system 36, the stored energy in tension spring 20 quickly retracts the spring and returns the pivoted lever arm 16 and lower lip 17 to their closed mouth positions, thereby reversing the direction of rotation for motor shaft 13 and rapidly unwinding string 14 from shaft 13 of the motor 12.

FIG. 3 shows a front view of the moving mouth mechanism of head 10 according to this invention. The pivotable lever arm is shown as a "U" shaped member 26, although other functionally equivalent shapes could be used. The lever arm 26 is rigidly attached at its outer end to the lower lip 17 and together they rotate about lip axis 18. Spool end 28 is attached to the outer end of motor shaft 13 and provides a convenient means for attaching the upper end of string 14 to the motor shaft. Spool end 28 also constrains the string 14 and prevents it from slipping off the end of the motor shaft 13 as it is wound onto and unwound from the shaft. The lower end of the string 14 is attached to the inner end of lever arm 26 at attachment point 27, but the attachment of tension spring 20 to lever arm 26 at an intermediate point 21 is omitted for reasons of clarity.

In practice, it has been found that a noticeable amount of "bounce" can occur when the moving mouth mechanism reaches the fully open position after electric power is disconnected from the motor 12, resulting in an unnatural speaking effect for the mouth 11. To counteract this bounce problem, a damper mechanism 30 is provided for shaft 13, and consists of a brake element 32 pivoted at lower end 33 and attached at its upper end to damper spring 34. The spring 34 tension is adjustable so as to provide a desired frictional force by the brake element 32 against the outer end of motor shaft 13 so as to inhibit undesired excessive rotation of the shaft after power to the motor 12 is interrupted, and thereby prevent undesired excessive opening of the lower lip 17 of mouth 11 for the head 10. Also, intermittent operation of the electric motor 12 is controlled by a control system 36 which may be located in the doll head 10 or the character body and is connected to a speaker 38 by wires 37 and which generates audio sounds. The control system 36 is also connected to the motor 12 by wire 39, and generates electrical signals and sounds which are synchronized with movements of the pivoted lower lip 17 of mouth 11 so as to simulate normal speaking sounds. A suitable control system is disclosed by a co-pending patent application Ser. No. 08/801,207 filed Feb. 18, 1997 and entitled "System and Method for Embedding and Extracting Control Signals for an Electrically Actuated Device", which is being incorpoated herein by reference to the extent necessary to adequately disclose the present invention.

Although this invention has been described broadly and by also in terms of a preferred embodiment, it will be understood that modifications and variations can be made within the scope as defined by the following claims.

We claim:

1. A moving mouth mechanism for an animated character, the mechanism comprising:

a head member including a mouth having a lower lip element which is pivotably mounted in the head member;

a pivotable lever element having an inner end and an outer end, and being attached at the outer end to said pivotable lower lip element;

an electric motor mounted in said head member, said motor having a shaft rotatable in either direction and having an integral shaft extension;

an elongated flexible element having its upper end attached to said motor rotatable shaft extension and having the flexible element lower end attached to said pivotable lever element at the lever inner end;

a resilient element having upper and lower ends and being attached at its upper end to said lever element; and an adjustable damping means arranged for providings a frictional force against said motor shaft extension; whereby the pivotable lower lip element is movable upward and downward by the pivotable lever element so as to simulate normal speech for the mouth of the animated character by the upper end of said elongated flexible element being intermittently wound onto and unwound from said rotatable motor shaft extension in response to the shaft intermittent rotation directions caused by the resilient element and electrical power being provided intermittently to the motor.

2. The moving mouth mechanism of claim 1, wherein said resilient element is attached at its upper end to said pivotable lever element at a point near the attachment of said elongated flexible element and said pivotable lever element.

3. The moving mouth mechanism of claim 1, wherein said damping means is aligned with and provides an adjustable fictional force against said motor shaft extension outer end.

4. The moving mouth mechanism of claim 1, wherein said elongated flexible element is a string.

5. The moving mouth mechanism of claim 1, wherein said resilient member is a tension spring.

6. The moving mouth mechanism of claim 1, wherein said resilient element is a tensioned rubber band.

7. The moving mouth mechanism of claim 1, wherein said head member is provided as part of an animated doll character which character is provided with an audio and control system adapted to provide intermittent operation of the electric motor and synchronize sounds and movements of the doll lower lip element.

8. A moving mouth mechanism for an animated character, the mechanism comprising:

a head member including a mouth having a lower lip element which is pivotably mounted in the head member;

a pivotable lever element having an inner end and an outer end, and being attached at the outer end to said pivotable lower lip element;

an electric motor mounted in said head member, said motor having a shaft which is rotatable in either direction of rotation and having an integral shaft extension;

an elongated flexible string having its upper end attached to said motor rotatable shaft extension and having the string lower end attached to said pivotable lever element at the lever inner end;

a tension type spring having an upper end attached to said lever element at a point near the lever inner end; and a damping means arranged to provide an adjustable fictional force against the motor shaft extension outer end, whereby the pivotable lower lip element is intermittently moved upward and downward by the pivotable lever element and the flexible string element being intermittently wound onto and unwound from said rotatable motor shaft extension in response to the shaft intermittent rotation directions caused by a control system so as to simulate normal speech for the mouth of the head member of the animated character.

9. The moving mouth mechanism of claim 1, wherein said resilient member is a compression type spring.

10. The moving mouth mechanism of claim 3, wherein said damping means includes a pivoted brake element controlled by an adjustable spring which applies a desired frictional force against the rotatable motor shaft extension outer end.

11. An animated character having a moving mouth mechanism mounted in a head of the animated character, the character comprising:

a head member including a mouth having a lower lip element which is pivotably mounted in the head member;

a pivotable lever element having an inner end and an outer end, and being attached at its outer end to said pivotable lower lip element;

an electric motor mounted in said head member, said motor having a shaft rotatable in either direction and having an integral shaft extension;

an elongated flexible element having its upper end attached to said motor rotatable shaft extension and having the flexible element lower end attached to said pivotable lever element at the lever inner end;

a resilient element having an upper end attached to said lever element;

a damping means arranged to provide an adjustable frictional force against the motor shaft extension outer end; and an audio and control system provided in the animated character, whereby the head member pivotable lower lip element is intermittently moved upward and downward by movements of the pivotable lever element and the resilient member in synchronism with sounds generated by the audio system and intermittent rotation of the motor shaft extension so that the flexible element upper end is wound onto the unwound from the rotatable motor shaft extension as caused by the control system so as to simulate speech for the mouth in the head member of the animated character.

12. The animated character of claim 11, wherein said resilient member is a spring attached to said pivotable lever element at a point intermediate the attachment point of the elongated flexible element and the pivotable lip element.

13. The animated character of claim 11, wherein said damping means includes a pivoted brake element controlled by an adjustable spring which applies a desired frictional force against the rotatable shaft extension outer end.

* * * * *